US010275837B2

(12) United States Patent
Jeffers et al.

(10) Patent No.: US 10,275,837 B2
(45) Date of Patent: Apr. 30, 2019

(54) RECOMMENDING A SOCIAL STRUCTURE

(71) Applicant: Microsoft Technology Licensing, LLC, Redmond, WA (US)

(72) Inventors: Jessica Suzanne Jeffers, Philadelphia, PA (US); Michael Junho Lee, Philadelphia, PA (US); Zhaoying Han, Mountain View, CA (US); Lutz Thomas Finger, Mountain View, CA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 332 days.

(21) Appl. No.: 14/928,488

(22) Filed: Oct. 30, 2015

(65) Prior Publication Data

US 2017/0124106 A1 May 4, 2017

(51) Int. Cl.
*G06Q 50/00* (2012.01)

(52) U.S. Cl.
CPC ..... *G06Q 50/01* (2013.01)

(58) Field of Classification Search
CPC ..... G06F 17/3097; G06F 17/3053; G06F 17/30867; G06F 17/3087; G06Q 50/01
See application file for complete search history.

(56) References Cited

U.S. PATENT DOCUMENTS 8,736,612 B1 * 5/2014 Goldman ..... G06Q 50/01 345/440
9,613,086 B1 * 4/2017 Sherman ..... G06F 17/30389
2011/0246483 A1 * 10/2011 Darr ..... G06Q 10/10 707/748
2013/0218797 A1 * 8/2013 Prichard ..... G06Q 50/265 705/325
2013/0254305 A1 * 9/2013 Cheng ..... H04L 51/32 709/206
2014/0095430 A1 * 4/2014 Ranjan ..... G06F 17/30345 707/609
2014/0095616 A1 * 4/2014 White ..... G06Q 50/02 709/204
2014/0188461 A1 * 7/2014 Myslinski ..... G06Q 10/10 704/9
2014/0214960 A1 * 7/2014 Allen ..... H04L 67/22 709/204
2015/0106365 A1 * 4/2015 Shah ..... G06Q 50/01 707/725

* cited by examiner

*Primary Examiner* — Kris E Mackes
*Assistant Examiner* — Lin Lin M Htay
(74) *Attorney, Agent, or Firm* — Schwegman Lundberg & Woessner, P.A.

(57) ABSTRACT

This disclosure relates to systems and methods for expanding a social network. A method includes generating respective social graphs for two or more entities, calculating one or more social metrics for each of the two or more entities using the respective social graphs, retrieving one or more performance metrics for each of the two or more entities, correlating the social metrics and the performance metrics to generate one or more associations between the social metrics and the performance metrics, and transmitting a recommendation for a requesting entity.

17 Claims, 11 Drawing Sheets

700

| Field | % Null | # Distinct | Mode | Mode Freq. |
|---|---|---|---|---|
| Industry ID | 31% | 148 | 68 | 5% |
| Degree | 21% | 9 | Bachelor's | 50% |
| Gender | 25% | 2 | MALE | 42% |
| Country | 5% | 256 | U.S. | 30% |

*FIG. 7*

RECOMMENDING A SOCIAL STRUCTURE

TECHNICAL FIELD

The subject matter disclosed herein generally relates to online social networking and, more particularly, to recommending a social network structure based on a performance preference for an entity.

BACKGROUND

A social network is a network of interconnected people. As technology advances, people across the world are becoming connected using social networks and are using social networking services to communicate and maintain connections with related people. Social connections in a social network can also affect how an entity that employs the people performs. How employees of an entity are connected via a social network can significantly influence performance metrics for the entity.

In one example, a performance preference is financial gains. In another example, a performance preference is employee satisfaction. In one example, greater connectivity via a social network increases employee satisfaction. However, in other scenarios, greater connectivity may inhibit financial success. Determining an appropriate level of connectedness for employees of an entity based, a least in part, on a performance preference for the entity is challenging.

BRIEF DESCRIPTION OF THE DRAWINGS

Some embodiments are illustrated by way of example and not limitation in the figures of the accompanying drawings.

FIG. 7 is a table illustrating data used by a recommend system, according to an example embodiment.

DETAILED DESCRIPTION

Figure 1:
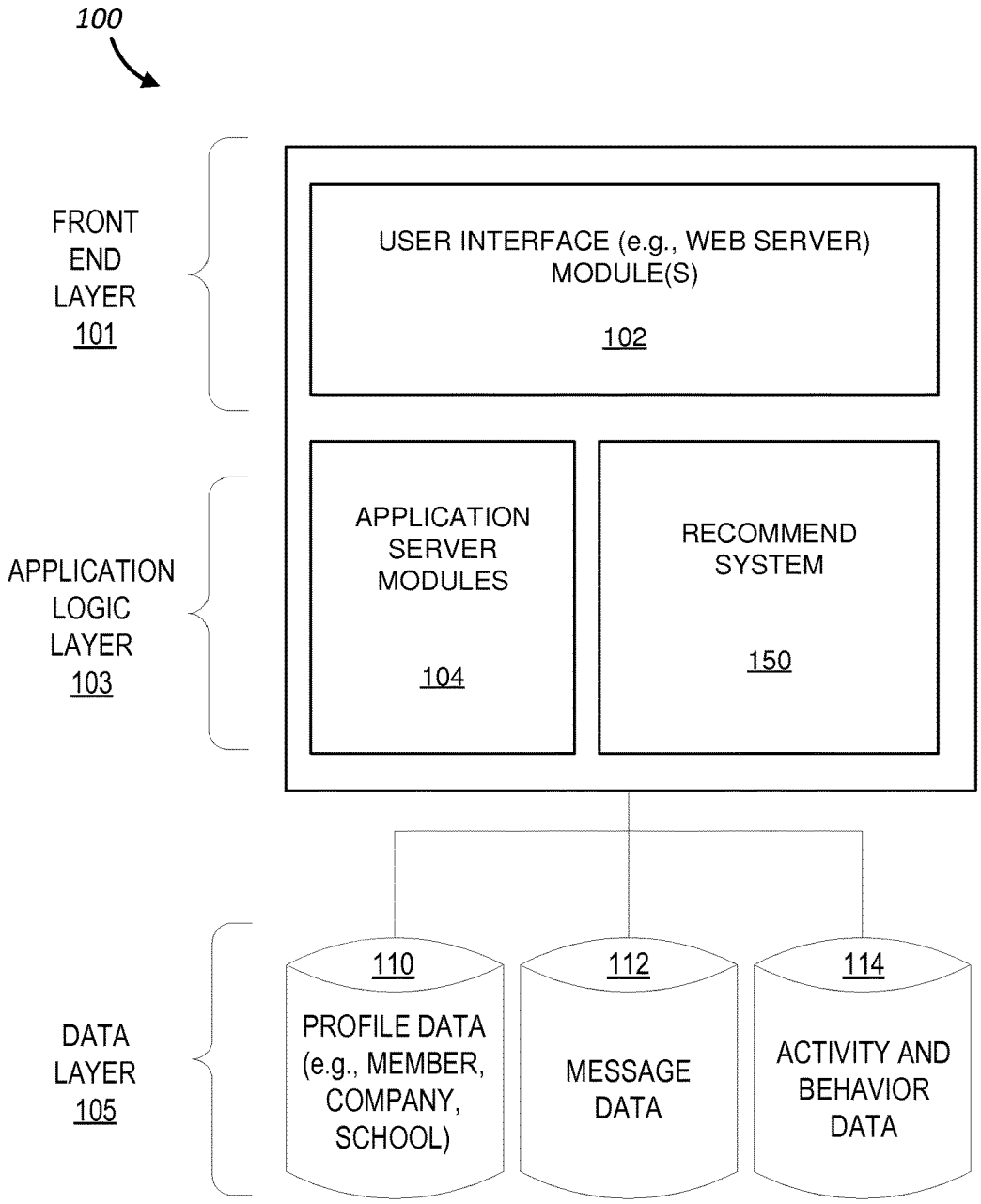
FIG. 1 is a block diagram illustrating various components or functional modules of an online social networking service, in an example embodiment.

The description that follows includes systems, methods, techniques, instruction sequences, and computing machine program products that embody illustrative embodiments of the inventive subject matter described in the present disclosure. In the following description, for the purposes of explanation, numerous specific details are set forth in order to provide an understanding of various embodiments of the inventive subject matter. It will be evident, however, to those skilled in the art, that embodiments of the inventive subject matter may be practiced without these specific details. In general, well-known instruction instances, protocols, structures, and techniques are not necessarily shown in detail.

Example methods and systems are directed to generating a social structure recommendation. Examples merely typify possible variations. Unless explicitly stated otherwise, components and functions are optional and may be combined or subdivided, and operations may vary in sequence or be combined or subdivided.

Techniques for recommending a social structure in an online social networking service have been developed that provide for generating social graphs for two or more entities. In one example embodiment, the social graphs include social connections in the online social networking service among persons who are associated with the respective entities. In one example, persons being associated with entities includes the persons being employed by the entities.

In one example embodiment, an entity includes a corporation. In another example embodiment, an entity includes a firm. In other embodiments, an entity is an organization that employs two or more persons. Of course, one skilled in the art may recognize other types of organizations, and this disclosure is not limited in this regard.

In certain example embodiments, a person being associated with an entity means the person being employed by the entity. Of course, a person may be associated with an entity in many other ways, such as, but not limited to, being in a contractual relationship with the entity, leading the entity, providing counsel to the entity, or the like.

According to example embodiments, a system generates links between the structure of a social network among persons associated with an entity and fundamental performance of the entity. In certain embodiments, performance of an entity includes at least one of financial profits, financial goals, financial policies, financial performance, stock value, assets, investment into a public cause, investment into innovation, charitable contributions, production goals, production performance, or other performance metrics.

In one example embodiment, the system discovers how a configuration of a social network among persons associated with an entity affects performance of the entity. Accordingly, the system, in other embodiments, generates recommendations to entities to indicate how formation of a specifically configured social network can assist an entity in achieving one or more performance goals. In one example, the system discovers that a denser social network increases an entity's employee satisfaction and contributes to a lower employee turnover, but of course, this is not necessarily the case. The system analyzes the social networks for the entities and compares the social networks with performance of the entities.

In one example embodiment, the recommendation indicates a number of hierarchal levels for the social network. In another example embodiment, the recommendation indicates whether managers should be socially connected with employees they manage. In certain embodiments, the system generates a recommendation for an entity based on a performance preference for the entity. Accordingly, the recommendation is specifically tailored according to the performance preference of the entity.

FIG. 1 is a block diagram illustrating various components or functional modules of an online social networking service 100, in an example embodiment. The online social networking service 100 may be utilized to generate social structure recommendations as described herein. In one example, the online social networking service 100 includes a recommend system 150 that performs the various operations described herein.

A front end layer 101 consists of one or more user interface modules (e.g., a web server) 102, which receive requests from various client computing devices and communicate appropriate responses to the requesting client devices. For example, the user interface module(s) 102 may receive requests in the form of Hypertext Transfer Protocol (HTTP) requests, or other web-based, application programming interface (API) requests. In another example, the front end layer 101 receives requests from an application executing via a member's mobile computing device. In one example, a member submits media content to be transmitted to other members of the online social networking service 100.

An application logic layer 103 includes various application server modules 104, which, in conjunction with the user interface module(s) 102, may generate various user interfaces (e.g., web pages, applications, etc.) with data retrieved from various data sources in a data layer 105.

In some examples, individual application server modules 104 may be used to implement the functionality associated with various services and features of the online social networking service 100. For instance, the ability of an organization to establish a presence in the social graph of the online social networking service 100, including the ability to establish a customized web page on behalf of an organization, and to publish messages or status updates on behalf of an organization, may be services implemented in independent application server modules 104. Similarly, a variety of other applications or services that are made available to members of the online social networking service 100 may be embodied in their own application server modules 104. Alternatively, various applications may be embodied in a single application server module 104.

In some examples, the online social networking service 100 includes the recommend system 150, which may retrieve contact lists, generate associations, filter the associations to remove contacts that are not non-members, and invite contacts that remain in the list of associations.

As illustrated, the data layer 105 includes, but is not necessarily limited to, several databases 110, 112, 114, such as a database 110 for storing profile data, including both member profile data and profile data for various organizations. In certain examples, the profile data includes the properties and/or characteristics of members of the online social networking service 100. Consistent with some examples, when a person initially registers to become a member of the online social networking service 100, the person may be prompted to provide some personal information, such as his or her name, age (e.g., birthdate), gender, sexual orientation, interests, hobbies, contact information, home town, address, spouse's and/or family members' names, educational background (e.g., schools, majors, matriculation and/or graduation dates, etc.), occupation, employment history, skills, religion, professional organizations, and other properties and/or characteristics. This information is stored, for example, in the database 110. Similarly, when a representative of an organization initially registers the organization with the online social networking service 100, the representative may be prompted to provide certain information about the organization. This information may be stored, for example, in the database 110, or another database (not shown). In some examples, the profile data may be processed (e.g., in the background or offline) to generate various derived profile data. For example, if a member has provided information about various job titles the member has held with the same or different companies, and for how long, this information can be used to infer or derive a member profile attribute indicating the member's overall seniority level, or seniority level within a particular company. In some examples, importing or otherwise accessing data from one or more externally hosted data sources may enhance profile data for both members and organizations. For instance, with companies in particular, financial data may be imported from one or more external data sources, and made part of a company's profile.

The online social networking service 100 may provide a broad range of other applications and services that allow members the opportunity to share and receive information, often customized to the interests of the member. For example, the online social networking service 100 may include a message sharing application that allows members to upload and share messages with other members. In some examples, members may be able to self-organize into groups, or interest groups, organized around a subject matter or topic of interest. In some examples, the online social networking service 100 may host various job listings providing details of job openings within various organizations.

As members interact with the various applications, services, and content made available via the online social networking service 100, information concerning content items interacted with, such as by viewing, playing, and the like, may be monitored, and information concerning the interaction may be stored, for example, in the database 114. In one example embodiment, the interactions are in response to a message requesting the interactions.

Although not shown, in some examples, the online social networking service 100 provides an API module via which third-party applications can access various services and data provided by the online social networking service 100. For example, using an API, a third-party application may provide a user interface and logic that enables a member to submit and/or configure a set of rules used by the recommend system 150. Such third-party applications may be browser-based applications, or may be operating system specific. In particular, some third-party applications may reside and execute on one or more mobile devices (e.g., phones, or tablet computing devices) having a mobile operating system.

Figure 2:
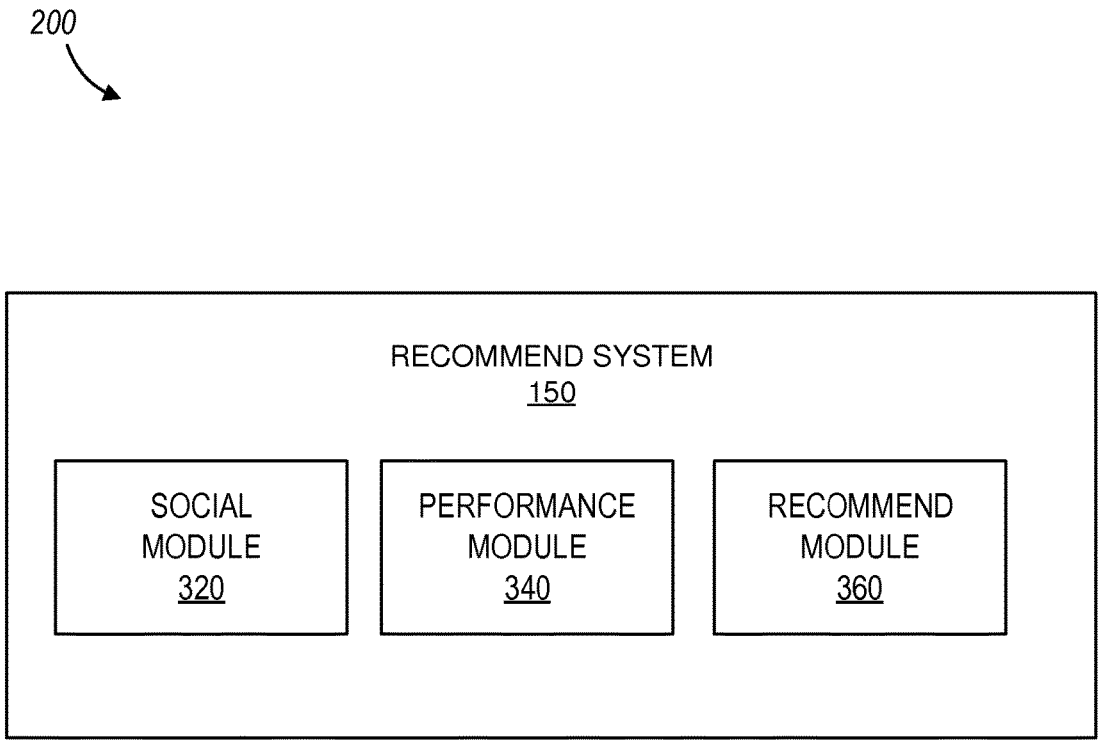
FIG. 2 is a block diagram illustrating components of a recommend system, according to one example embodiment.

FIG. 2 is a block diagram 200 illustrating components of a recommend system 150, according to one example embodiment. In one example embodiment, the recommend system 150 includes a social module 320, a performance module 340, and a recommend module 360.

In one example embodiment, the social module 320 is configured to generate a social graph for an entity. In another example embodiment, the social module 320 generates respective social graphs for two or more entities. A social graph, in one example, includes connections among members of a social network that are associated with the respective entities.

Figure 3:
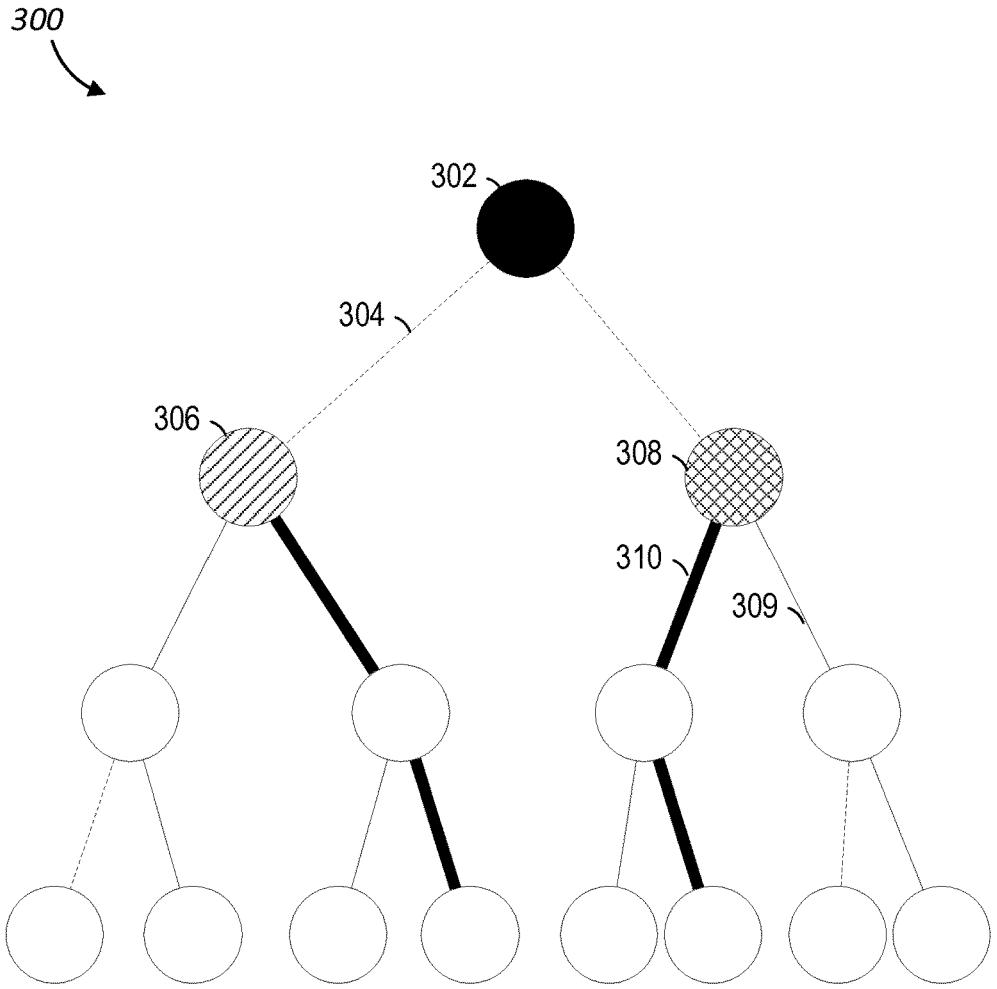
FIG. 3 is a diagram illustrating a social graph according to one example embodiment.
Figure 4:
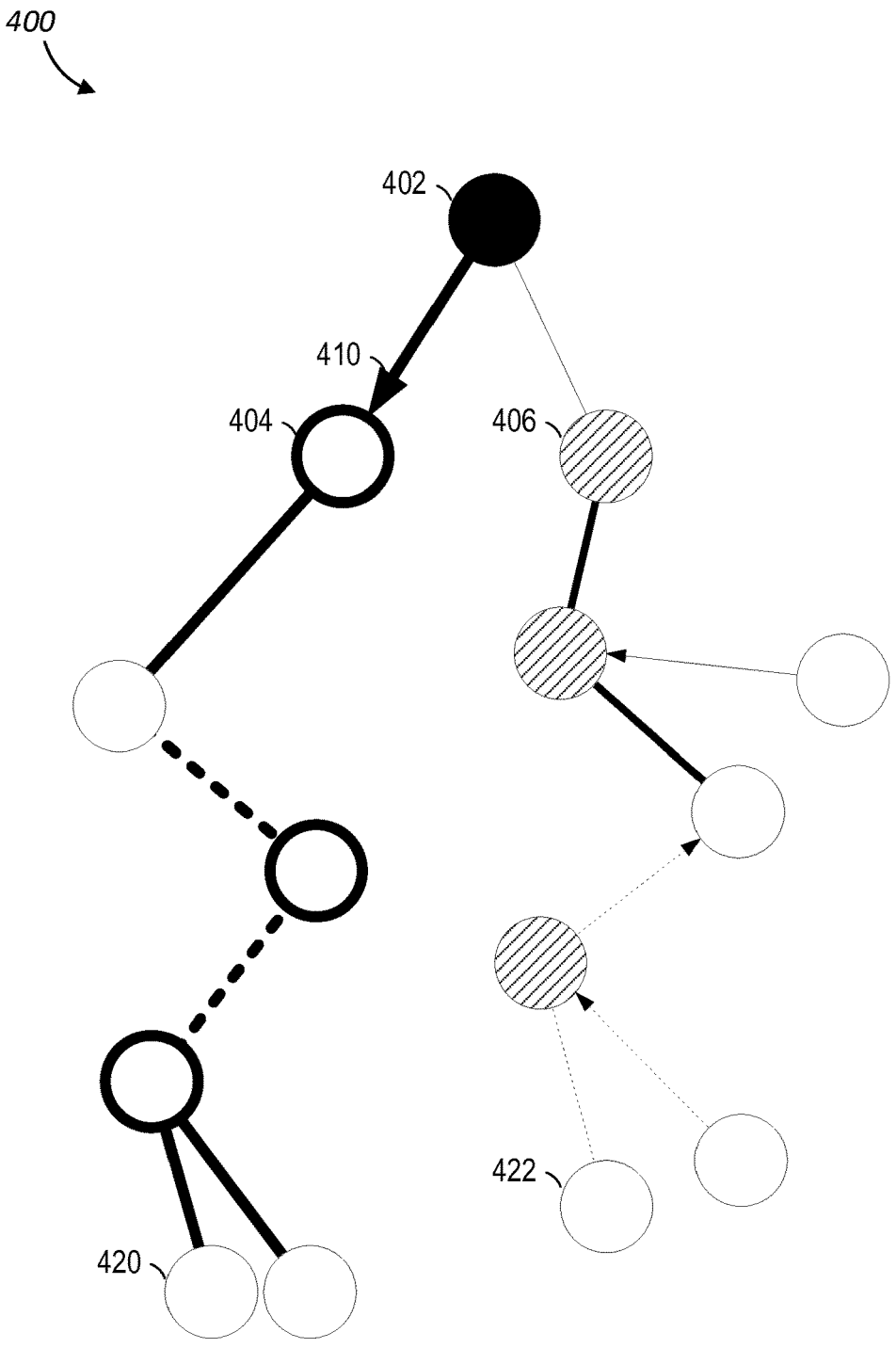
FIG. 4 is another diagram illustrating a social graph according to one example embodiment.
Figure 5:
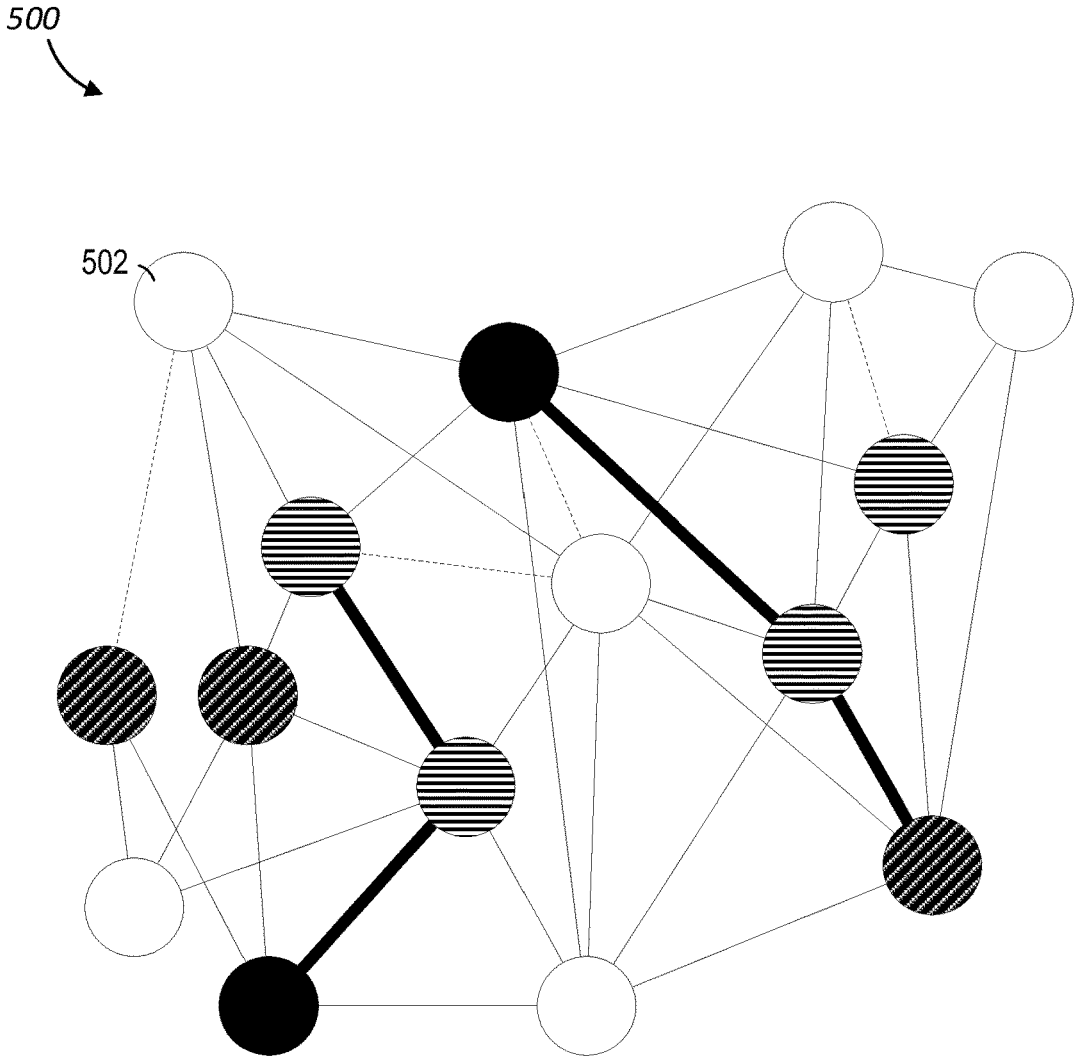
FIG. 5 is a diagram illustrating a social graph according to another example embodiment.

For example, where five different people are members of an online social networking service, and each of the five different people is employed by the same corporation, the social module 320 generates a social graph that includes the five persons. The social graph may also indicate properties of each connection among the members. In one example embodiment, the social graph indicates a duration of a connection using a thickness of a line representing the connection. In another example embodiment, the social graph indicates how long a person has been a member of the social networking service using graphical properties of a node representing the person. In one example, a node representing a person who has been a member of the social networking service for more than five years may be represented by a specific pattern in the graphical node. Specific, non-limiting examples of social graphs are depicted in FIGS. 3-5.

In another example embodiment, the social module 320 also generates a legend as part of the social graph to indicate which patterns or graphical properties indicate aspects of the members and/or connections among members of the social networking service that are associated with the entity represented by the social graph.

In another example embodiment, the social module 320 calculates one or more social metrics for each of the two or more entities using the respective social graphs. In one example embodiment, the social module 320 determines a density metric for each entity using the social graph. In one example, the social module 320 determines the density metric using an average number of connections among members of the online social networking service that are associated with the entity.

A social metric may be an average social network distance among members. In another example embodiment, the social module 320 determines an average social network distance among members of the online social networking service that are associated with an entity. An average social networking distance is an average number of connections that are traversed from each member of the online social networking service that is associated with the entity to each other member of the social networking service that is associated with the entity.

A social metric may be an average graph diameter. In another example embodiment, the social module 320 determines an average graph diameter by measuring a number of connections traversed going from one edge node of the social graph to each other edge node of the social graph. In one example, an edge node is a node of the social graph that is connected to two or fewer other members of the online social networking service that are associated with the entity.

A social metric may also be a percentage of participation. In one example embodiment, the social module 320 determines a percentage of participation by dividing a number of persons associated with an entity who are members of the online social networking service by a total number of persons associated with the entity.

In one example embodiment, the social metric is a social network length. In one example, the social module 320 determines a length of the social graph. In one example, the length of the social graph is determined by calculating a minimum path from each node to each other node in the social graph, the length being the number of nodes traversed in the longest minimum path.

In another example embodiment, the social metric is a social network width. In one example, the social module 320 determines a width of the social graph by calculating a maximum number of nodes at a given level of the social graph. Specific examples are described in FIGS. 3-5.

In another example, the social module 320 determines an average width of the social graph. An average width of a social graph, in one example, is an average of the minimum paths from each node of the social graph to each other node in the social graph. In one example embodiment, the social module 320 determines that the social graph is a "silo" graph based, at least in part, on the social graph having a width that is below a threshold value. In one example, the threshold value is four, and in response to the social graph having a width of four or less, the social module 320 determines that the social graph is a "silo" graph.

In another example embodiment, the social metric is an average distance from a manager. In one example, the social module 320 determines an average social network distance between a manager and persons managed by the manager that are members of the social networking service. In one example, a social network distance is a number of connections between the manager and a managed employee.

In another example embodiment, the social metric is an average number of degrees between each pair of members of the social networking service that are associated with an entity. In one example, the social module 320 counts an average number of connections among members of an online social networking service that are also associated with an entity.

In another example embodiment, the social metric is a ratio of a number of connections for members of the online social networking service that are associated with the entity. For example, where an entity includes 1,000 persons and the number of connections for those persons in the online social networking service is 5,000, the ratio is 5:1.

In another example embodiment, the social module 320 includes gender as a limiting factor in calculating a social metric. In one example, the social module 320 limits social metric analysis to males that are members of the social networking service and are associated with the entity. Of course, this is not necessarily the case, and the social module 320 may also limit social metric analysis to females.

In one example embodiment, the social metric is based on connections that cross educational boundaries. In one example, the social metric is a ratio of connections that cross educational boundaries to connections that do not. In one example, the social module 320 counts the number of connections where the persons connected have varying educational credentials. In one example, one person has a bachelor's degree and another person has a doctoral degree. The social module 320 may then count the connections that cross educational boundaries and divide the result by a total number of connections. In other embodiments, the social module 320 includes boundaries such as, but not limited to, experience boundaries, job function boundaries, cultural boundaries, or the like.

In one example embodiment, the social module 320 anonymizes the people in the social networking service. In one example, the social module 320 assigns a numerical value to each person.

In another example embodiment, the social module 320 considers seniority of connections and/or directionality of connections. In one example, the social module 320 weights connections with a directionality that is consistent with seniority at the entity. In one example, where a manger initiates a connection with a managed person, the directionality is consistent with seniority. In another example, where a managed person initiates a connection with an officer of a corporation, the directionality is not consistent with the seniority.

In other embodiments, the social module 320 includes a person's age, activity level, experience, education, seniority, job function, and connections to persons outside of the entity's social graph to determine a social metric of the social graph for the entity. Of course, this disclosure is not limited in this regard, and the social module 320 may use any aspect of an entity, persons employed by the entity, or the like in determining a social metric of a social graph for the entity.

In one example embodiment, the social module 320 determines that a social graph is "open" in response to a ratio of connections between persons associated with the entity to a total number of persons associated with the entity being above a threshold value. In another example, the social module 320 determines that a social graph is "closed" in response to a ratio of connections to persons associated with the entity being below a threshold number. In these ways, as described herein, the social module 320 determines a property of a social graph using one or more social metrics.

In another example embodiment, the social module 320 filters input data by removing data that is incomplete, inconsistent, misrepresentative, biased, or the like. In one example, input data from an entity may not meet a data integrity value. In one example, an integrity value is percentage completion. In one example, gender input data may be less than 50% complete and fail to meet an integrity threshold. In response, the social module 320 removes the gender field from inclusion in the input data.

In another example embodiment, the integrity value is a mode frequency threshold. In one example, the threshold value is 5%. In response to input data from an entity having a mode frequency of less than 5%, the social module 320 does not include the entity in the social graph calculations.

In another example embodiment, the integrity threshold is a number of distinct values. In response, the social module 320 does not include an entity in the social graphs where one of the input data fields does not have the threshold number of distinct values. Of course, an administrator for the system may define other input data integrity thresholds, and this disclosure is not limited in this regard.

In another example embodiment, the social module 320 limits selection of entities for participation to entities that are in a specific geographic region. In one example, the geographic region is a country, such as the United States of America. Of course, this disclosure is not limited in this regard, and any geographic region may be used, such as, but not limited to, a continent, a country, a state, a county, a city, a municipality, or the like. In one example, the social module 320 selects entities where persons associated with the entities report in their respective member profiles that the entities are located at a geographic location.

In another example embodiment, the social module 320 limits selection of entities for participation to entities that satisfy one or more financial metrics. In certain examples, a financial metric is selected from annual profits, stock value, number of employees, prior bankruptcies, stock volume, ROI, or the like.

In one example embodiment, the social module 320 publishes a social graph for an entity. In one example, the social module 320 publishes a graphical representation of the social graph via a web server. In another example, the social module 320 publishes the social graph by exporting a series of numerical values that represents the social graph. Of course, one skilled in the art may recognize other ways in which a social graph may be published, and this disclosure is not limited in this regard.

In one example embodiment, the performance module 340 is configured to retrieve one or more performance metrics for each of two or more entities. In one example, the performance module 340 retrieves financial performance data from a remote server. In one example, a remote server provides public performance data for an entity. In certain examples, the public performance data includes financial performance, stock values, return on investment, average employee education, employee turnover, employee compensation packages, employee satisfaction, intellectual property, trademarks, patents, research, development, manufacturer statistics, production rates, production type, charity, entrenchment, restatements, policy, policy change frequency, or any other property, parameter, or characteristic of an entity.

In one example embodiment, the performance module 340 correlates social metrics with performance metrics based on one or more recognized patterns. In one example, as more than a threshold number of entities include a social graph with one or more specific social metrics and one or more specific public performance metrics, the performance module 340 correlates the social metrics with the performance metrics.

In one specific example, the threshold number of entities is 10. In response to 10 or more entities having an "open" social graph and a stock value that exceeds $10 per share, the performance module 340 correlates the "open" social graph to a stock value of $10 or greater. In another example embodiment, the threshold number of entities is set by an administrator of the recommend system 150.

In another example, the performance module 340 correlates social metrics with performance metrics in response to the social metric being present in social graphs for a percentage of entities with similar performance metrics. In one example, in response to half of the entities having a top 10% density social graph, and being in the top 10% of issued patents, the social module correlates social graph density with innovation. In this example, the recognized pattern is dense social graphs and issued patents.

In one example embodiment, the recommend module 360 is configured to transmit a recommendation for a requesting entity. In one example, an entity requests a recommended social structure to increase a stock value to $10 or above (one example of a performance preference). In response, the recommend module 360 transmits discovered correlations between social metrics and a stock value of $10 or above.

In another example, an entity requests a recommended social structure to decrease employee turnover (another example of a performance preference). In response, the recommend module 360 transmits a discovered social metric that correlates with the performance metric of employee turnover. In one specific example, entities with employee turnover rates that are lower than a majority of other entities share similar social metrics, and the recommend module 360 may transmit those associated social metrics to the entity that requests the recommendation.

In one example embodiment, the social module 320 retrieves social network data for a requesting entity from the online social network service the recommend module 360 generates a recommendation according to the requested performance preference.

In another example embodiment, the recommendation includes a rating of how the requesting entity is performing regarding the performance preference compared with other entities with members in the online social networking service. In another example embodiment, the recommend module 360 includes general social metrics which may instruct a requesting entity regarding general improvements that can be made to the entity's social network based, at least in part, on determined social metrics that improve performance metrics.

In one example embodiment, the recommendation includes whether a manager should be connected to managed employees and the nature of the connection in the online social networking service. In another example, the recommendation may include whether or not the CEO should be connected to other employees of the entity.

In one example embodiment, the recommend module 360 compares a requesting entity with industry specific recommendations based, at least in part, on the performance of other entities in the specific industry. In one example, the entity is an auto manufacturer. In response to a performance request from the entity, the recommend module 360 generates a recommendation generated using other auto manufacturers in the online social networking service.

FIG. 3 is a diagram illustrating a social graph 300 according to one example embodiment. In this example embodiment, the social graph 300 was generated by the social module 320 for a specific entity. As depicted in FIG. 3, a node 302 includes a fill pattern and represents the CEO of the entity. The node 302 representing the CEO is connected with nodes 306 and 308.

In one example embodiment, the nodes 306 and 308 are managers of the entity represented by various fill patterns as indicated in FIG. 3. In one example, the node 306 represents a human resources manager of the entity. In another example, the node 308 represents an officer of the entity. In one example embodiment, connection 304 between the node 302 and the nodes 306, 308 are represented using a dotted line. In one example, the dotted line indicates that the connection is less than a year old. In another example, the dotted line indicates limited access to member profiles in the online social networking service. Of course, the dotted line may indicate other properties of the connection between nodes, and this disclosure is not limited in this regard.

In another example embodiment, the officer represented by the node 308 of the social graph 300 is connected to some nodes using a thinner line 309, and connected to other nodes using a thicker line 310. In one example embodiment, the thickness of the line indicates a duration of the connection between nodes. In other embodiments, the line thickness indicates access levels, or other parameters of the connection.

The social graph 300 of FIG. 3 closely represents a hierarchal structure at the entity because, in this example, the entity is structured with a CEO, two regional managers (represented by nodes 306 and 308), et al.

FIG. 4 is another diagram illustrating a social graph 400 according to one example embodiment. According to this example embodiment, the social graph 400 includes an array of nodes connected in a "silo" configuration.

A social graph in a "silo" configuration means that an average number of connections per node is below a threshold number. In this example, an average number of connections per node is 13 (total connections) divided by 14 (total nodes)=0.93. In one example, in response to a number of connections per node being below a value of one, the social module 320 designates the social graph as a "silo."

In another example, the social module determines a number of connections including connection directionality. In one example, connections (e.g., connection 408) without arrows include connections that are bi-directional (e.g., persons represented by either node share equal access permissions, or similar). Furthermore, in this example, connections with arrows (e.g., connection 410) indicate connections that are one direction (e.g., unequal permissions between persons represented by the nodes). In this example, the total number of connections is 22, and the average number of connections per node is 1.57 (22/14).

In other example embodiment, the social module 320 determines that a social graph is a "silo" in response to a number of degrees (e.g., a number of connections) to get from one node to another exceeding a threshold value. In one example, the social module 320 counts a number of connections traversed to reach each other node in the social graph. For example, to get from node 420 to node 422, the number of connections that are traversed is ten. The social module 320 determines the number of connections traversed to reach each other node in the social graph, then divides the total by the number of nodes. In response to the result being above a threshold value, such as six, for example, the social module 320 determines that the social graph is a "silo."

As indicated in FIG. 3, a "silo" social graph leaves many nodes disconnected from other nodes. For example, there is no direct social connection between node 420 and node 422, or any other node in the branch attached by node 406.

The social graph 400 includes one node 402 connected to two other nodes 404 and 406. The node 402 includes a solid fill pattern, while the node 406 includes a diagonal line fill pattern. As one skilled in the art may appreciate, the various graphical features of the nodes and/or connections may indicate a wide variety of different aspects of the social graph 400. In one example, thicker lines indicate connections between similarly educated persons, while thinner lines indicate cross-educational connections. In another example, thicker lines indicate a higher frequency of communication between persons (e.g., nodes) than connections with thinner lines. In other examples, dotted lines indicate communication below a threshold amount per unit time. For example, where persons communicate via the online social networking service less than one time per month, the connection between them may be represented using a dotted line. Of course, this is not necessarily the case, and this disclosure is not limited in this regard.

In another example embodiment, an arrow 410 indicates a directionality of the connection. In one example, the arrow 410 indicates that the person represented by node 402 initiated the connection to the person indicated by node 404. In another example, the arrow 410 indicates that node 402 has access to node 404 (e.g., may access personal information for the person represented by node 404). Of course, the arrow 410 may indicate other properties of the connection between node 402 and node 404, and this disclosure is not limited in this regard.

FIG. 5 is a diagram illustrating a social graph 500 according to another example embodiment. Like FIGS. 3 and 4, FIG. 5 depicts a social graph. In this example embodiment, the social graph 500 has a higher density than the social graph 300 or the social graph 400.

In one example embodiment, the social module 320 determines a social graph density by dividing the number of connections by the number of nodes. In another example embodiment, the social module 320 determines a social graph density by determining an average number of connections per node. Of course, the social module 320 may determine other social metrics using the social graph, and this disclosure is not limited in this regard.

In another example embodiment, the social module 320 publishes the social graph 500. In one example, the social module 320 generates a three-dimensional (3D) representation of the social graph 500. In another example, the social module 320 generates one or more images. In another example, the social module 320 generates a video of a virtual depiction of the social graph 500.

In one example, the social module 320 publishes the social graph 500 by displaying the social graph 500 via a web page. In another example, the social module 320 publishes the social graph 500 by transmitting an image of the social graph 500 to a remote server. Of course, one skilled in the art may recognize many other ways in which a social graph may be published, and this disclosure includes all such ways.

Figure 6:
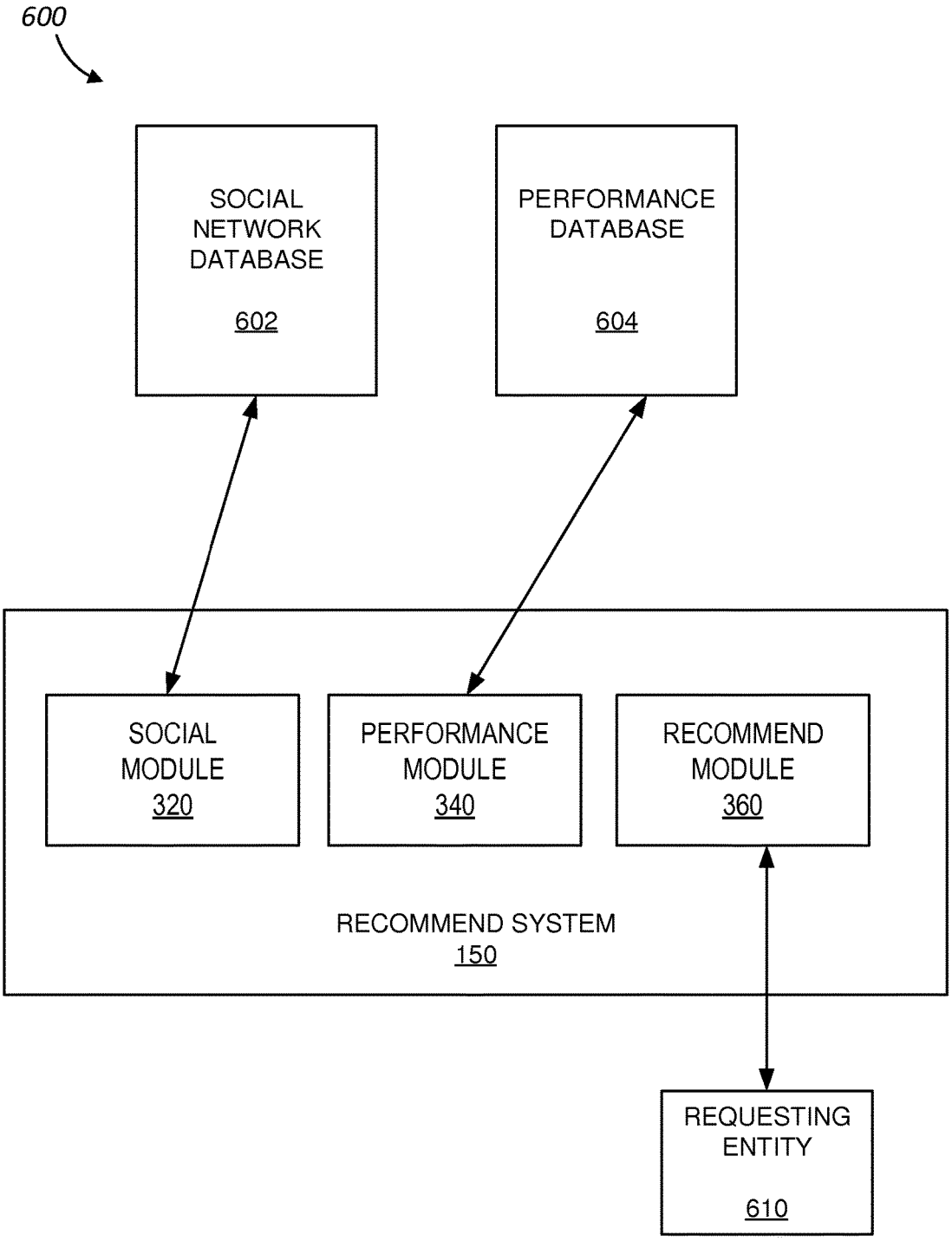
FIG. 6 is a schematic block diagram illustrating one example scenario that includes a recommend system, according to one example embodiment.

FIG. 6 is a schematic block diagram illustrating one example scenario 600 that includes a recommend system 150, according to one example embodiment. In this example embodiment, the scenario 600 includes the recommend system 150, a social network database 602, a performance database 604, and a requesting entity 610.

In one example embodiment, the social module 320, operating as part of the recommend system 150, requests social network data from the social network database 602. In one specific example, the social network database 602 is the database 110 of FIG. 1. In this example, the social module 320 requests social network data from the social network database 602 using a remote network connection.

In another example embodiment, the performance module 340, operating as part of the recommend system 150, retrieves performance data for an entity from the performance database 604. In one example, the performance module 340 retrieves the performance data from a remote server using an API, as one skilled in the art may appreciate. The performance module 340 may retrieve financial data, economic data, published exchange data, central bank data, government agency data, and private company data. Of course, the performance module 340 may retrieve an entity's performance metrics from other sources, and this disclosure is not limited in this regard.

In another example embodiment, the recommend system 150 retrieves social metrics and performance metrics for many entities and correlates the social metrics with the performance metrics based on recognized patterns between the metrics. In one example, entities with higher-density social graphs exhibit increased employee satisfaction, and decreased employee turnover. In certain examples, recognized patterns include social metrics and performance metrics occurring in a higher percentage of entities that exceed a threshold of statistical variation. In one example, In one example embodiment, the recommend system 150 receives a request for a recommendation from the requesting entity 610. The request may include a performance preference from the requesting entity 610. In one example, the performance preference is stock price. In another example, the performance preference is employee turnover. In one example, the requesting entity 610 is Entity X. In response to the request, the recommend system 150 retrieves social metrics for Entity X from the social network database 602. The social module 320 generates a social graph for Entity X.

In one example embodiment, the recommend module 360 transmits a recommendation to Entity X that includes the social metrics correlating with the performance preference. In this example, the performance preference includes a performance metric and the recommend module 360 indicates which social metrics correlate with the requested performance metric.

FIG. 7 is a table illustrating data 700 used by the recommend system 150, according to an example embodiment. In this example embodiment, the input data 700 was retrieved from the online social networking service 100. For example, the social module 320 may request data from the database 110.

According to certain examples, the social module 320 determines characteristics of the input data. In one example, the characteristics include a % Null, a number of distinct responses, a mode of the input data, and a mode frequency of the input data. In one example, % Null means a percentage of the data values being empty or incomplete. In another example, a mode of the input data is a highest represented data value in the input data. In one example, a mode frequency of the input data indicates a percentage of the data values that equal the mode of the input data.

In one example embodiment, the social module 320 cleans the input data before the data is used to generate correlations between social metrics and performance metrics. In one example, the Industry ID field is removed from the data in response to the data having a % Null value above a threshold value. For example, where the threshold value is 30%, in response to the Industry ID field having a % Null value of 31% (indicating that 31% of the records do not include this field), the social module 320 removes the field from the data. In this way, the field is not included in correlating social metrics with performance metrics.

In another example embodiment, the Gender field is removed from the data because the number of distinct data values for the field are too few. For example, the social module 320 may limit input data to data that includes a number of distinct responses that is above or below a threshold value, or within a threshold range. In one example, a threshold range is between 20 and 100. In response to the Gender field having fewer than 20 distinct responses (in this example, Gender having two distinct responses), the social module 320 may not include Gender in the correlation techniques described herein. In another example, because the Country field has more than 100 distinct data values, the social module 320 may also not include Country in the correlation techniques. Of course, other values may be used, and this disclosure is not limited in this regard.

Figure 8:
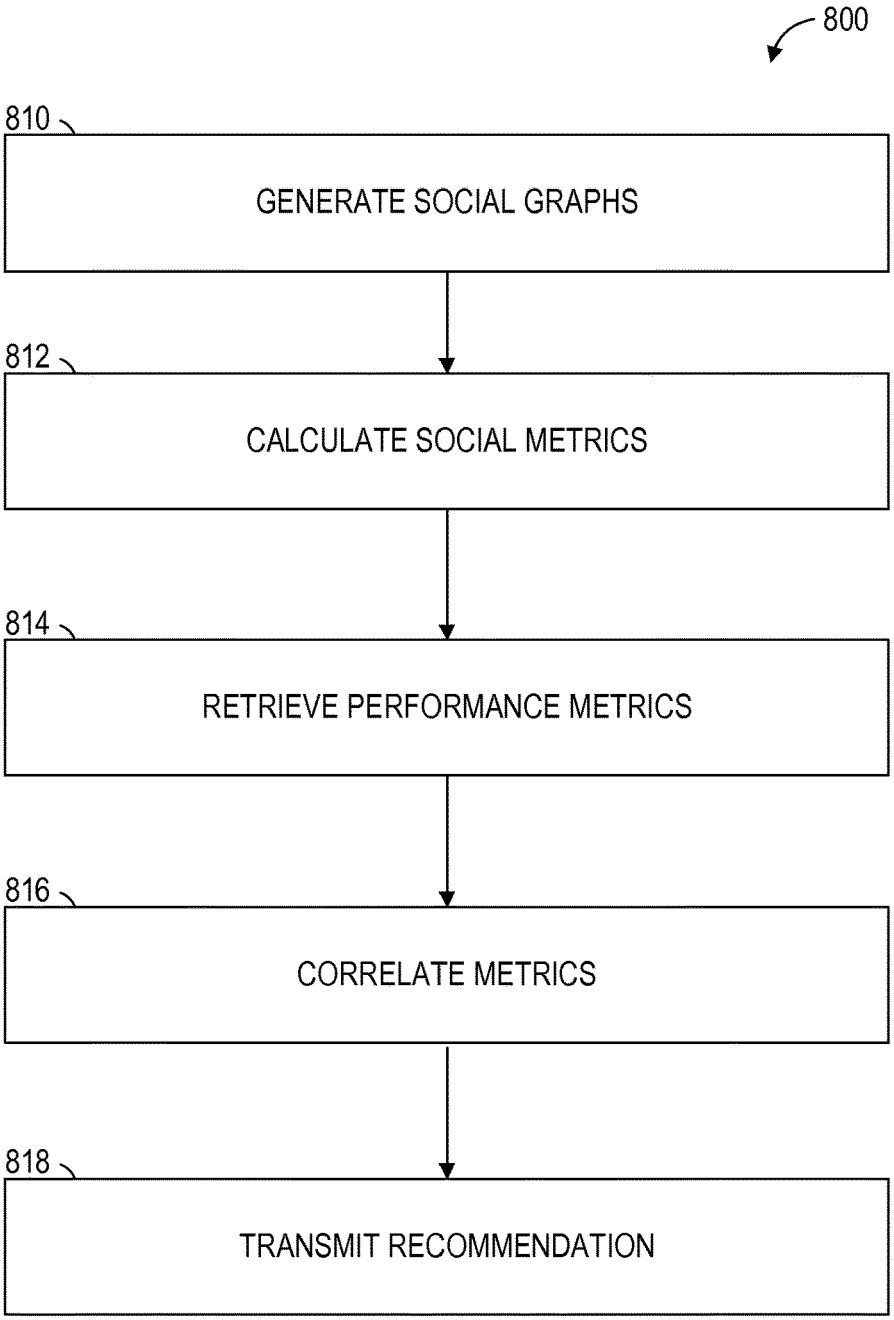
FIG. 8 is a flow chart diagram illustrating a method of generating a recommendation, according to an example embodiment.

FIG. 8 is a flow chart diagram illustrating a method 800 of generating a recommendation, according to an example embodiment. According to one example embodiment, the method 800 is performed by one or more modules of the recommend system 150 and is described by way of reference thereto.

In one example embodiment, the method 800 begins and at operation 810 the social module 320 generates respective social graphs for many entities. In one example, the social graphs include connections between members of the online social networking service 100 that are associated with the respective entities.

The method 800 continues at operation 812 and the social module 320 calculates one or more social metrics for each of the respective entities using the generated social graphs. In one example, the social module 320 determines a social graph density.

The method 800 continues at operation 814 and the performance module 340 retrieves performance metrics for each of the respective entities. In one example, the performance module 340 retrieves the performance metrics from an online data source, as one skilled in the art may appreciate.

The method 800 continues at operation 816 and the recommend module 360 correlates social metrics with performance metrics based, at least in part, on recognized patterns. The method 800 continues at operation 818 and the recommend module 360 transmits a recommendation to a requesting entity that recommends a social metric that has previously been correlated to a performance preference of a performance metric. In one example, the requesting entity requests a performance preference of financial profits and the recommend module 360 recommends one or more social metrics that correlate with the performance metric of financial profits.

Figure 9:
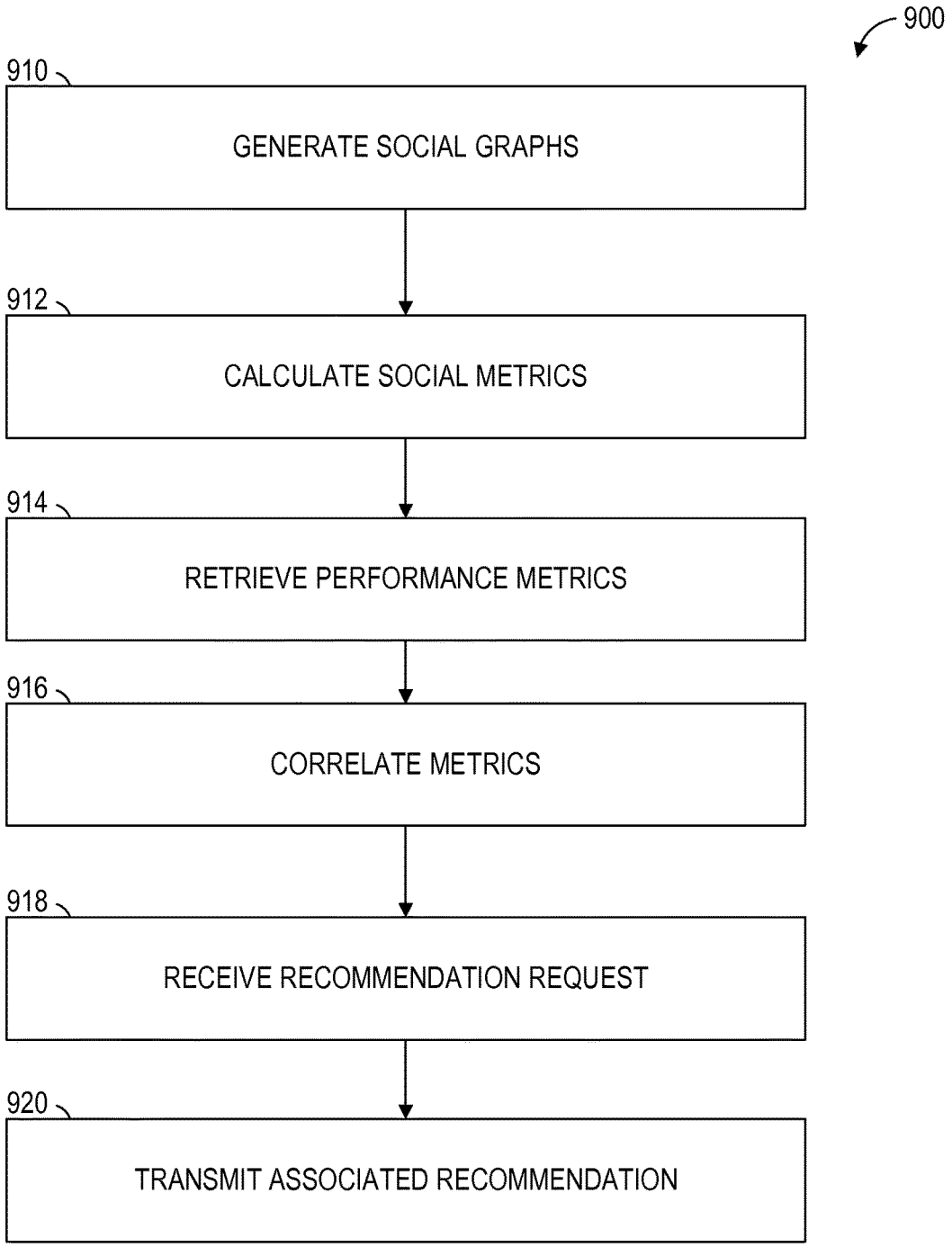
FIG. 9 is a flow chart diagram illustrating another method of generating a recommendation, according to an example embodiment.

FIG. 9 is a flow chart diagram illustrating another method 900 of generating a recommendation, according to an example embodiment. According to one example embodiment, the method 900 is performed by one or more modules of the recommend system 150 and is described by way of reference thereto.

In one example embodiment, the method 900 begins and at operation 910 the social module 320 generates many social graphs for various entities where persons associated with the entities are members of the online social networking service 100. The method 900 continues at operation 912 and the social module 320 calculates one or more social metrics using the social graphs.

The method 900 continues at operation 914 and the performance module 340 retrieves performance metrics for the entities from a database. In one example, the database is a public financial performance database. In another example, the database is a data service provided by a remote server.

The method 900 continues at operation 916 and the recommend module 360 correlates the social metrics determined in operation 912 with the performance metrics retrieved at operation 914. In one example, the correlations are based on recognized patterns between the social metrics and the performance metrics.

The method 900 continues at operation 918 and the recommend module 360 receives a recommendation request. In one example, the recommend module 360 receives a message from an entity requesting a recommendation. In another example, an administrator for the recommend system 150 configures a recommendation request.

The method 900 continues at operation 920 and the recommend module 360 transmits a recommendation to an entity that requested a recommendation. In one example, the recommendation includes a recommended social structure (e.g., a social metric) that correlates with an indicated performance preference from the entity that requested the recommendation as described herein.

Figure 10:
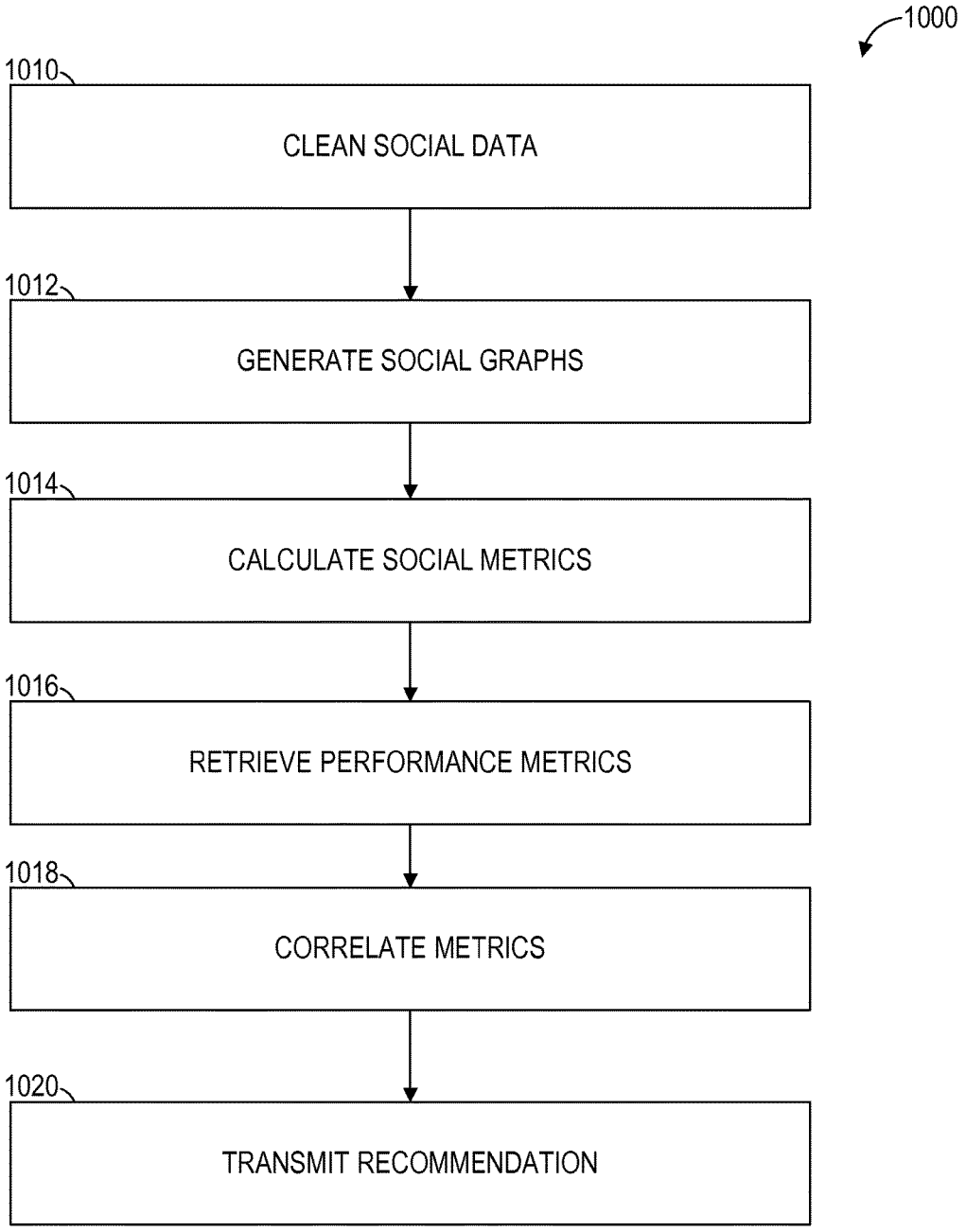
FIG. 10 is another flow chart diagram illustrating a method of generating a recommendation, according to an example embodiment.

FIG. 10 is another flow chart diagram illustrating a method 1000 of generating a recommendation, according to an example embodiment. According to one example embodiment, the method 1000 is performed by one or more modules of the recommend system 150 and is described by way of reference thereto.

In one example embodiment, the method 1000 begins and at operation 1010, the social module 320 cleans social data by removing data that does not satisfy an integrity threshold value. In one example, a threshold value is a minimum number of distinct values. In response to one data field not including the minimum number of distinct values, the social module 320 removes the data field from inclusion in the social graphs.

The method 1000 continues at operation 1012 and the social module 320 generates one or more social graphs for various entities where persons associated with the entities are members of the online social networking service 100. The method 1000 continues at operation 1014 and the social module 320 calculates one or more social metrics by traversing the social graphs.

The method 1000 continues at operation 1016 and the performance module 340 retrieves performance metrics for the entities from a database. In one example, the database is a public financial performance database. In another example, the database is a data service provided by a remote server.

The method 1000 continues at operation 1018 and the recommend module 360 correlates the social metrics determined in operation 1014 with the performance metrics retrieved at operation 1016. In one example, the correlations are based on recognized patterns between the social metrics and the performance metrics.

The method 1000 continues at operation 1020 and the recommend module 360 transmits a recommendation to an entity that requested a recommendation. In one example, the recommendation includes a recommended social structure (e.g., a social metric) that correlates with an indicated performance preference from the entity that requested the recommendation as described herein.

Modules, Components, and Logic

Certain embodiments are described herein as including logic or a number of components, modules, or mechanisms. Modules may constitute either software modules (e.g., code embodied on a machine-readable medium) or hardware modules. A "hardware module" is a tangible unit capable of performing certain operations and may be configured or arranged in a certain physical manner. In various example embodiments, one or more computer systems (e.g., a standalone computer system, a client computer system, or a server computer system) or one or more hardware modules of a computer system (e.g., a processor or a group of processors) may be configured by software (e.g., an application or application portion) as a hardware module that operates to perform certain operations as described herein.

In some embodiments, a hardware module may be implemented mechanically, electronically, or any suitable combination thereof. For example, a hardware module may include dedicated circuitry or logic that is permanently configured to perform certain operations. For example, a hardware module may be a special-purpose processor, such as a Field-Programmable Gate Array (FPGA) or an Application Specific Integrated Circuit (ASIC). A hardware module may also include programmable logic or circuitry that is temporarily configured by software to perform certain operations. For example, a hardware module may include software executed by a general-purpose processor or other programmable processor. Once configured by such software, hardware modules become specific machines (or specific components of a machine) uniquely tailored to perform the configured functions and are no longer general-purpose processors. It will be appreciated that the decision to implement a hardware module mechanically, in dedicated and permanently configured circuitry, or in temporarily configured circuitry (e.g., configured by software) may be driven by cost and time considerations.

Accordingly, the phrase "hardware module" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented module" refers to a hardware module. Considering embodiments in which hardware modules are temporarily configured (e.g., programmed), each of the hardware modules need not be configured or instantiated at any one instance in time. For example, where a hardware module comprises a general-purpose processor configured by software to become a special-purpose processor, the general-purpose processor may be configured as respectively different special-purpose processors (e.g., comprising different hardware modules) at different times. Software accordingly configures a particular processor or processors, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple hardware modules exist contemporaneously, communications may be achieved through signal transmission (e.g., over appropriate circuits and buses) between or among two or more of the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module implemented using one or more processors.

Similarly, the methods described herein may be at least partially processor-implemented, with a particular processor or processors being an example of hardware. For example, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an API).

The performance of certain of the operations may be distributed among the processors, not only residing within a single machine, but deployed across a number of machines. In some example embodiments, the processors or processor-implemented modules may be located in a single geographic location (e.g., within a home environment, an office environment, or a server farm). In other example embodiments, the processors or processor-implemented modules may be distributed across a number of geographic locations.

Machine and Software Architecture

The modules, methods, applications, and so forth described in conjunction with FIGS. 1-10 are implemented in some embodiments in the context of a machine and an associated software architecture. The sections below describe a representative architecture that is suitable for use with the disclosed embodiments.

Software architectures are used in conjunction with hardware architectures to create devices and machines tailored to particular purposes. For example, a particular hardware architecture coupled with a particular software architecture will create a mobile device, such as a mobile phone, tablet device, or so forth. A slightly different hardware and software architecture may yield a smart device for use in the "internet of things," while yet another combination produces a server computer for use within a cloud computing architecture. Not all combinations of such software and hardware architectures are presented here, as those of skill in the art can readily understand how to implement the inventive subject matter in different contexts from the disclosure contained herein.

Example Machine Architecture and Machine-Readable Medium

Figure 11:
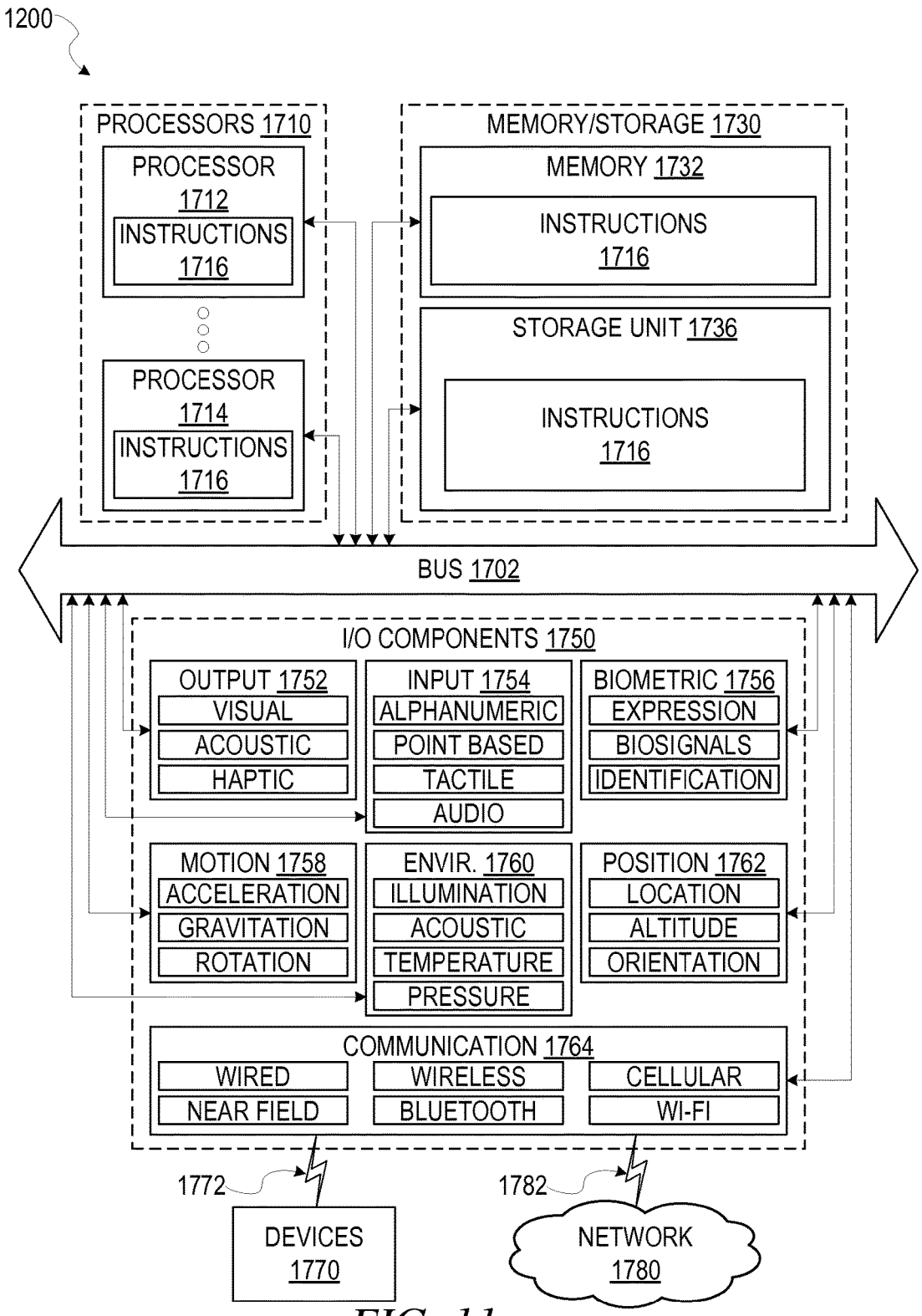
FIG. 11 is a block diagram illustrating components of a machine, according to some example embodiments, able to read instructions from a machine-readable medium (e.g., a machine-readable storage medium) and perform any one or more of the methodologies discussed herein

FIG. 11 is a block diagram illustrating components of a machine 1200, according to some example embodiments, able to read instructions from a machine-readable medium (e.g., a machine-readable storage medium) and perform any one or more of the methodologies discussed herein. Specifically, FIG. 11 shows a diagrammatic representation of the machine 1200 in the example form of a computer system, within which instructions 1716 (e.g., software, a program, an application, an applet, an app, or other executable code) for causing the machine 1200 to perform any one or more of the methodologies discussed herein may be executed. For example the instructions may cause the machine to execute the flow diagrams of FIGS. 8-10. Additionally, or alternatively, the instructions may implement one or more of the components of FIG. 2. The instructions transform the general, non-programmed machine into a particular machine programmed to carry out the described and illustrated functions in the manner described. In alternative embodiments, the machine 1200 operates as a standalone device or may be coupled (e.g., networked) to other machines. In a networked deployment, the machine 1200 may operate in the capacity of a server machine or a client machine in a server-client network environment, or as a peer machine in a peer-to-peer (or distributed) network environment. The machine 1200 may comprise, but not be limited to, a server computer, a client computer, a personal computer (PC), a tablet computer, a laptop computer, a netbook, a personal digital assistant (PDA), or any machine capable of executing the instructions 1716, sequentially or otherwise, that specify actions to be taken by the machine 1200. Further, while only a single machine 1200 is illustrated, the term "machine" shall also be taken to include a collection of machines 1200 that individually or jointly execute the instructions 1716 to perform any one or more of the methodologies discussed herein.

The machine 1200 may include processors 1710, memory/storage 1730, and I/O components 1750, which may be configured to communicate with each other such as via a bus 1702. In an example embodiment, the processors 1710 (e.g., a Central Processing Unit (CPU), a Reduced Instruction Set Computing (RISC) processor, a Complex Instruction Set Computing (CISC) processor, a Graphics Processing Unit (GPU), a Digital Signal Processor (DSP), an ASIC, a Radio-Frequency Integrated Circuit (RFIC), another processor, or any suitable combination thereof) may include, for example, a processor 1712 and a processor 1714 that may execute the instructions 1716. The term "processor" is intended to include multi-core processors that may comprise two or more independent processors (sometimes referred to as "cores") that may execute instructions contemporaneously. Although FIG. 11 shows multiple processors, the machine 1200 may include a single processor with a single core, a single processor with multiple cores (e.g., a multi-core processor), multiple processors with a single core, multiple processors with multiples cores, or any combination thereof.

The memory/storage 1730 may include a memory 1732, such as a main memory, or other memory storage, and a storage unit 1736, both accessible to the processors 1710 such as via the bus 1702. The storage unit 1736 and memory 1732 store the instructions 1716 embodying any one or more of the methodologies or functions described herein. The instructions 1716 may also reside, completely or partially, within the memory 1732, within the storage unit 1736, within at least one of the processors 1710 (e.g., within the processor's cache memory), or any suitable combination thereof, during execution thereof by the machine 1200. Accordingly, the memory 1732, the storage unit 1736, and the memory of the processors 1710 are examples of machine-readable media.

As used herein, "machine-readable medium" means a device able to store instructions and data temporarily or permanently and may include, but not be limited to, random-access memory (RAM), read-only memory (ROM), buffer memory, flash memory, optical media, magnetic media, cache memory, other types of storage (e.g., Erasable Programmable Read-Only Memory (EEPROM)), and/or any suitable combination thereof. The term "machine-readable medium" should be taken to include a single medium or multiple media (e.g., a centralized or distributed database, or associated caches and servers) able to store the instructions 1716. The term "machine-readable medium" shall also be taken to include any medium, or combination of multiple media, that is capable of storing instructions (e.g., instructions 1716) for execution by a machine (e.g., machine 1200), such that the instructions, when executed by one or more processors of the machine 1200 (e.g., processors 1710), cause the machine 1200 to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" excludes signals per se.

The I/O components 1750 may include a wide variety of components to receive input, provide output, produce output, transmit information, exchange information, capture measurements, and so on. The specific I/O components 1750 that are included in a particular machine will depend on the type of machine. For example, portable machines such as mobile phones will likely include a touch input device or other such input mechanisms, while a headless server machine will likely not include such a touch input device. It will be appreciated that the I/O components 1750 may include many other components that are not shown in FIG. 11. The I/O components 1750 are grouped according to functionality merely for simplifying the following discussion and the grouping is in no way limiting. In various example embodiments, the I/O components 1750 may include output components 1752 and input components 1754. The output components 1752 may include visual components (e.g., a display such as a plasma display panel (PDP), a light emitting diode (LED) display, a liquid crystal display (LCD), a projector, or a cathode ray tube (CRT)), acoustic components (e.g., speakers), haptic components (e.g., a vibratory motor, resistance mechanisms), other signal generators, and so forth. The input components 1754 may include alphanumeric input components (e.g., a keyboard, a touch screen configured to receive alphanumeric input, a photo-optical keyboard, or other alphanumeric input components), point based input components (e.g., a mouse, a touchpad, a trackball, a joystick, a motion sensor, or other pointing instruments), tactile input components (e.g., a physical button, a touch screen that provides location and/or force of touches or touch gestures, or other tactile input components), audio input components (e.g., a microphone), and the like.

In further example embodiments, the I/O components 1750 may include biometric components 1756, motion components 1758, environmental components 1760, or position components 1762, among a wide array of other components. For example, the biometric components 1756 may include components to detect expressions (e.g., hand expressions, facial expressions, vocal expressions, body gestures, or eye tracking), measure biosignals (e.g., blood pressure, heart rate, body temperature, perspiration, or brain waves), identify a person (e.g., voice identification, retinal identification, facial identification, fingerprint identification, or electroencephalogram based identification), and the like. The motion components 1758 may include acceleration sensor components (e.g., accelerometer), gravitation sensor components, rotation sensor components (e.g., gyroscope), and so forth. The environmental components 1760 may include, for example, illumination sensor components (e.g., photometer), temperature sensor components (e.g., one or more thermometers that detect ambient temperature), humidity sensor components, pressure sensor components (e.g., barometer), acoustic sensor components (e.g., one or more microphones that detect background noise), proximity sensor components (e.g., infrared sensors that detect nearby objects), gas sensors (e.g., gas detection sensors to detect concentrations of hazardous gases for safety or to measure pollutants in the atmosphere), or other components that may provide indications, measurements, or signals corresponding to a surrounding physical environment. The position components 1762 may include location sensor components (e.g., a Global Position System (GPS) receiver component), altitude sensor components (e.g., altimeters or barometers that detect air pressure from which altitude may be derived), orientation sensor components (e.g., magnetometers), and the like.

Communication may be implemented using a wide variety of technologies. The I/O components 1750 may include communication components 1764 operable to couple the machine 1200 to a network 1780 or devices 1770 via a coupling 1782 and a coupling 1772 respectively. For example, the communication components 1764 may include a network interface component or other suitable device to interface with the network 1780. In further examples, communication components 1764 may include wired communication components, wireless communication components, cellular communication components, Near Field Communication (NFC) components, Bluetooth® components (e.g., Bluetooth® Low Energy), Wi-Fi® components, and other communication components to provide communication via other modalities. The devices 1770 may be another machine or any of a wide variety of peripheral devices (e.g., a peripheral device coupled via a Universal Serial Bus (USB)).

Moreover, the communication components 1764 may detect identifiers or include components operable to detect identifiers. For example, the communication components 1764 may include Radio Frequency Identification (RFID) tag reader components, NFC smart tag detection components, optical reader components (e.g., an optical sensor to detect one-dimensional bar codes such as Universal Product Code (UPC) bar code, multi-dimensional bar codes such as Quick Response (QR) code, Aztec code, Data Matrix, Dataglyph, MaxiCode, PDF417, Ultra Code, UCC RSS-2D bar code, and other optical codes), or acoustic detection components (e.g., microphones to identify tagged audio signals).

In addition, a variety of information may be derived via the communication components 1764, such as location via Internet Protocol (IP) geolocation, location via Wi-Fi® signal triangulation, location via detecting an NFC beacon signal that may indicate a particular location, and so forth.

Transmission Medium

In various example embodiments, one or more portions of the network 1780 may be an ad hoc network, an intranet, an extranet, a virtual private network (VPN), a local area network (LAN), a wireless LAN (WLAN), a wide area network (WAN), a wireless WAN (WWAN), a metropolitan area network (MAN), the Internet, a portion of the Internet, a portion of the Public Switched Telephone Network (PSTN), a plain old telephone service (POTS) network, a cellular telephone network, a wireless network, a Wi-Fi® network, another type of network, or a combination of two or more such networks. For example, the network 1780 or a portion of the network 1780 may include a wireless or cellular network and the coupling 1782 may be a Code Division Multiple Access (CDMA) connection, a Global System for Mobile communications (GSM) connection, or another type of cellular or wireless coupling. In this example, the coupling 1782 may implement any of a variety of types of data transfer technology, such as Single Carrier Radio Transmission Technology (1×RTT), Evolution-Data Optimized (EVDO) technology, General Packet Radio Service (GPRS) technology, Enhanced Data rates for GSM Evolution (EDGE) technology, third Generation Partnership Project (3GPP) including 3G, fourth generation wireless (4G) networks, Universal Mobile Telecommunications System (UMTS), High Speed Packet Access (HSPA), Worldwide Interoperability for Microwave Access (WiMAX), Long Term Evolution (LTE) standard, others defined by various standard-setting organizations, other long range protocols, or other data transfer technology.

The instructions 1716 may be transmitted or received over the network 1780 using a transmission medium via a network interface device (e.g., a network interface component included in the communication components 1764) and utilizing any one of a number of well-known transfer protocols (e.g., HTTP). Similarly, the instructions 1716 may be transmitted or received using a transmission medium via the coupling 1772 (e.g., a peer-to-peer coupling) to the devices 1770. The term "transmission medium" shall be taken to include any intangible medium that is capable of storing, encoding, or carrying the instructions 1716 for execution by the machine 1200, and includes digital or analog communications signals or other intangible media to facilitate communication of such software.

Language

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The Detailed Description, therefore, is not to be taken in a limiting sense, and the scope of various embodiments is defined only by the appended claims, along with the full range of equivalents to which such claims are entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. These and other variations, modifications, additions, and improvements fall within a scope of embodiments of the present disclosure as represented by the appended claims. The specification and drawings are, accordingly, to be regarded in an illustrative rather than a restrictive sense.

What is claimed is:

1. A system comprising:

a machine-readable medium having instructions stored thereon, which, when executed by a processor, cause the system to:

generate respective social graphs for two or more entities, the respective social graphs including connections between members of a social network that are associated with the two or more entities, wherein each member is associated with one of the two or more entities;

calculate social metrics for each of the two or more entities using the respective social graphs, wherein the social metrics comprise all of the following:

a density metric of an average number of connections among members that are associated with the two or more entities, an average social network distance among members that are associated with the two or more entities, an average diameter of the respective social graphs, a percentage of participation of the members associated with the two or more entities, a length of the social network, a width of the social network; and an average distance from a manager to a non-manager on the respective social graphs;

retrieve one or more performance metrics for each of the two or more entities;

correlate, based upon recognized patterns and by generating links between the members of the social network that are associated with the two or more entities and fundamental performance of the two or more entities, the one or more social metrics and the one or more performance metrics to generate one or more associations between the one or more social metrics and the one or more performance metrics; and transmit a recommendation for a requesting entity, the recommendation including a correlated social metric, the recommendation in response to the requesting entity specifying a performance preference, and the recommendation based on the performance preference;

wherein the recommendation indicates a number of hierarchical levels for the respective social graphs of the two or more entities, and wherein the recommendation recommends that members having a first job type not be connected with members having a second job type; and wherein the instructions further cause the system to filter data used to generate the respective social graphs by removing data that falls below an integrity threshold value.

2. The system of claim 1, wherein the instructions further cause the system to publish one or more of the respective social graphs.

3. The system of claim 1, wherein the two or more entities are selected from a plurality of entities that report in corresponding member profiles that the two or more entities are located at a geographic location.

4. The system of claim 1, wherein the two or more entities comprise entities that satisfy one or more financial metrics.

5. The system of claim 1, wherein the recommendation further includes a recommended management structure for the requesting entity.

6. The system of claim 1, wherein the performance preference is selected from a group consisting of financial profits, stock value, employee turnover, social status, and employee compensation.

7. A method comprising:

generating respective social graphs for two or more entities, the respective social graphs including connections between members of a social network that are associated with the two or more entities, wherein each member is associated with one of the two or more entities;

calculating social metrics for each of the two or more entities using the respective social graphs, wherein the social metrics comprise all of the following:

a density metric of an average number of connections among members that are associated with the two or more entities, an average social network distance among members that are associated with the two or more entities, an average diameter of the respective social graphs, a percentage of participation of the members associated with the two or more entities, a length of the social network, a width of the social network, and an average distance from a manager to a non-manager on the respective social graphs;

retrieving one or more performance metrics for each of the two or more entities;

correlating, based upon recognized patterns and by generating links between the members of the social network that are associated with the two or more entities and fundamental performance of the two or more entities, the one or more social metrics and the one or more performance metrics to generate one or more associations between the one or more social metrics and the one or more performance metrics; and transmitting a recommendation for a requesting entity, the recommendation including a correlated social metric, the recommendation in response to the requesting entity specifying a performance preference, and the recommendation based on the performance preference;

wherein the recommendation indicates a number of hierarchical levels for the respective social graphs of the two or more entities, and wherein the recommendation recommends that members having a first job type not be connected with members having a second job type; and wherein the instructions further cause the system to filter data used to generate the respective social graphs by removing data that falls below an integrity threshold value.

8. The method of claim 7, further comprising publishing one or more of the respective social graphs.

9. The method of claim 7, wherein the two or more entities are selected from a plurality of entities that report in corresponding member profiles that the two or more entities are located at a geographic location.

10. The method of claim 7, wherein the two or more entities comprise entities that satisfy one or more financial metrics.

11. The method of claim 7, wherein the recommendation further includes a recommended management structure for the requesting entity.

12. The method of claim 7, wherein the performance preference is selected from a group consisting of financial profits, stock value, employee turnover, social status, and employee compensation.

13. A non-transitory machine-readable medium having instructions stored thereon, which, when executed by a processor, cause the processor to perform operations comprising:

generating respective social graphs for two or more entities, the respective social graphs including connections between members of a social network that are associated with the two or more entities, wherein each member is associated with one of the two or more entities;

calculating social metrics for each of the two or more entities using the respective social graphs, wherein the social metrics comprise all of the following:

a density metric of an average number of connections among members that are associated with the two or more entities, an average social network distance among members that are associated with the two or more entities, an average diameter of the respective social graphs, a percentage of participation of the members associated with the two or more entities; a length of the social network, a width of the social network, and an average distance from a manager to a non-manager on the respective social graphs;

retrieving one or more performance metrics for each of the two or more entities;

correlating, based upon recognized patterns and by generating links between the members of the social network that are associated with the two or more entities and fundamental performance of the two or more entities, the one or more social metrics and the one or more performance metrics to generate one or more associations between the one or more social metrics and the one or more performance metrics; and transmitting a recommendation for a requesting entity, the recommendation including a correlated social metric, the recommendation in response to the requesting entity specifying a performance preference, and the recommendation based on the performance preference;

wherein the recommendation indicates a number of hierarchical levels for the respective social graphs of the two or more entities, and wherein the recommendation recommends that members having a first job type not be connected with members having a second job type; and wherein the instructions further cause the system to filter data used to generate the respective social graphs by removing data that falls below an integrity threshold value.

14. The non-transitory machine-readable medium of claim 13, wherein the instructions further cause the processor to publish one or more of the respective social graphs.

15. The non-transitory machine-readable medium of claim 13, wherein the two or more entities are selected from a plurality of entities that report in corresponding member profiles that the two or more entities are located at a geographic location.

16. The non-transitory machine-readable medium of claim 13, wherein the two or more entities comprise entities that satisfy one or more financial metrics.

17. The non-transitory machine-readable medium of claim 13, wherein the recommendation further includes a recommended management structure for the requesting entity.

* * * * *